US007585195B2

(12) United States Patent
Vartdal

(10) Patent No.: US 7,585,195 B2
(45) Date of Patent: Sep. 8, 2009

(54) PROPULSION AND STEERING UNIT FOR A WATERBORNE VESSEL

(76) Inventor: Leif Vartdal, Hovsetrása 54, N-6065 Ulsteinvik (NO)

( * ) Notice: Subject to any disclaimer, the term of this patent is extended or adjusted under 35 U.S.C. 154(b) by 0 days.

(21) Appl. No.: 11/733,788

(22) Filed: Apr. 11, 2007

(65) Prior Publication Data

US 2007/0275613 A1 Nov. 29, 2007

(30) Foreign Application Priority Data

Apr. 20, 2006 (NO) ..... 20061745

(51) Int. Cl.
*B63H 20/08* (2006.01)

(52) U.S. Cl. ..... 440/63

(58) Field of Classification Search ..... 440/63
See application file for complete search history.

(56) References Cited

U.S. PATENT DOCUMENTS

| | | | | |
|---|---|---|---|---|
| 2,156,938 | A | 2/1939 | Edwards | |
| 2,372,247 | A | 3/1945 | Billing | |
| 3,422,780 | A | 1/1969 | Becker | |
| 3,486,478 | A | 12/1969 | Halliday | |
| 3,605,678 | A * | 9/1971 | Shimanckas | 440/58 |

(Continued)

FOREIGN PATENT DOCUMENTS

DE 3207398 9/1983

(Continued)

*Primary Examiner*—Stephen Avila
(74) *Attorney, Agent, or Firm*—Christian Abel

(57) ABSTRACT

A propulsion and steering unit for a waterborne vessel. The propulsion and steering unit is in the form of an azimuth thruster 1 comprising a propeller 2 fixed to one end of a propeller shaft 4, which is rotatable about a longitudinal axis 6. Fixed to the other end of the propeller shaft 4 there is a beveled gear crown wheel 8. The crown wheel 8 is engaged with a driving pinion gear 10 and, in this particular embodiment, the crown wheel 8 is driven in a direction 7 by the driving pinion gear 10. The driving pinion gear 10 is mounted on a vertical drive shaft 12, which is connected to drive means (not shown) for the vessel. A longitudinal axis 18 of the drive shaft 12, about which the drive pinion 8 rotates, is substantially perpendicular to the longitudinal axis 6 of the propeller shaft 4 about which the propeller 2 rotates. On the top of the azimuth thruster 1 there is positioned a steering engine (not shown), which turns the thruster so that the pulling force vector can be orientated in a decided direction from 0-360 degrees, or a multiple of 360 degrees in both directions. Normally a steering engine consists of hydraulic or electric motors which are connected to a gear rim connected to a vertical stem on the thruster. If the thruster 1 is rotated in still water with the propeller disconnected, this will be easily rotated with a minimum of torque independent of direction. However, if the vessel is moving then due to the propeller forces and the dynamic characteristics of the slipstream there will be a variable torque resistance that varies with rotation rate and vessel speed. If the resistance is larger than the torque steering engine is able to give, the thruster will rotate against the pressure torque from the steering engine. The reason for this is the hydraulic (or flow induced) contribution and the torque archieved on the vertical shaft 12 due to the rotation of the shaft 12.

4 Claims, 5 Drawing Sheets

U.S. PATENT DOCUMENTS 6,623,320 B1 * 9/2003 Hedlund ..... 440/80

FOREIGN PATENT DOCUMENTS

EP 1013544 6/2000
JP 08-207895 2/1952
NL 29700 12/1932
WO WO 2005/012075 2/2005

* cited by examiner

Steering torque coefficient with and without fin

Hydrodynamic and total steering torque
24 knots, 1700 kW, Dp=2.1m (fixed pitch mode)

PROPULSION AND STEERING UNIT FOR A WATERBORNE VESSEL

FIELD OF THE INVENTION

The present invention relates to a propulsion and steering unit for a waterborne vessel and is concerned practically, although not exclusively, with a propulsion and steering unit of the type that comprises an azimuth pod having a propeller shaft rotatable about a first axis with a propeller externally of the front of the pod, the pod being rotatable about a second axis not being in parallel with the first axis.

BACKGROUND OF THE INVENTION

Traditional ships have been provided with a propulsion propeller and a separate steering rudder. These propulsion and steering means are then generally attached to the stern of the ship so that the driving force for the ship is exerted by the propulsion propeller and operations, such as turning of the ship, are carried out by the rudder.

Recently the propeller and the rudder have been integrated in one propulsion and steering device, a so-called azimuth propeller device. This azimuth propeller device includes one or several propulsion propellers mounted on a shaft placed in an underwater housing or pod, which is turnable around a substantially vertical axis. By turning the shaft it is possible to direct the propeller flow in any direction, and therefore the azimuth propeller may also function as the steering device of the ship.

SUMMARY OF THE INVENTION

The present invention concerns a propulsion and steering unit in the form of a new pulling mechanical for waterborne vessels; known as azimuth thrusters. Propulsion units may be either of the "pulling" or "pushing" type. That a propulsion unit is "pulling" means that the propeller of the azimuth has been placed in the direction of the propulsion of a vessel and should therefore be considered as pulling in contrast to the situation when the propeller has been orientated in the opposite direction to the propulsion direction. In this last situation it is used a term "pushing" thruster.

While there are several advantages with orientating the azimuth thruster as a pulling one, one of the disadvantages is that the steering engine torque requirement will increase considerably in relation to pushing thrusters. The implication of this is that the part of the unit which is onboard the vessel will have to be physically larger, which also may have a negative influence on the costs.

Therefore, one aspect of the present invention is to provide a propulsion and steering unit which reduce the requirement to the steering engine torque in order to keep it to a minimum.

According to a first aspect of the present invention there is provided a propulsion and steering unit for a waterborne vessel comprising a pod housing having front and rear ends, a propeller and propeller shaft, the propeller being disposed externally at the front of the pod and being rotatable about a longitudinal axis of a propeller shaft, the propeller shaft being drivingly connected to drive means, the unit comprising steering means that rotate the unit about an axis substantially perpendicular to the longitudinal axis of the propeller, the drive means comprising a driving pinion and a driven wheel, the location of the driving pinion on the driven wheel is such that, in use, the rotational direction of the drive pinion produces a torque that acts against a maximum hydrodynamic torque generated by a rotation of the propeller and a rotation of the unit by the steering means.

The location of the driving pinion on the driven wheel is preferably such that, in use, the rotational direction of the drive pinion produces a torque that acts with a minimum hydrodynamic torque generated by a rotation of the unit by the steering means.

Preferably, the axis of rotation of the driving pinion is located forward of the driven wheel.

The axis of rotation of the drive pinion is preferably substantially perpendicular to the axis of rotation of the propeller.

The propulsion and steering unit preferably comprises a fin element that extends from an aft region of the pod housing.

It shall be appreciated that the present invention may include a thruster comprising a fixed pitch bladed propellers or alternatively controllable pitch propellers. The number of blades on the propellers may also vary and the propeller may be a six laded propeller.

BRIEF DESCRIPTION OF THE DRAWINGS

Specific embodiments of the invention and variants thereof will now be described by way of example only with reference to the accompanying drawing, in which.

DETAILED DESCRIPTION

Figure 1:
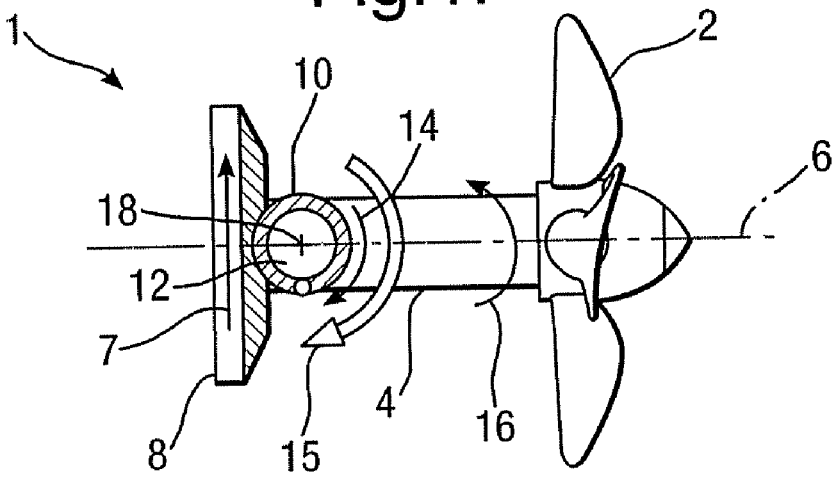
FIG. 1 is a plan view of part of a propulsion and steering unit showing the arrangement of a drive pinion and a driven wheel.

With reference to FIG. 1, there is shown part of a propulsion and steering unit for a waterborne vessel. The propulsion and steering unit is in the form of an azimuth thruster 1 comprising a propeller 2 fixed to one end of a propeller shaft 4, which is rotatable about a longitudinal axis 6. Fixed to the other end of the propeller shaft 4 there is a beveled gear crown wheel 8. The crown wheel 8 is engaged with a driving pinion gear 10 and, in this particular embodiment, the crown wheel 8 is driven in a direction 7 by the driving pinion gear 10. The driving pinion gear 10 is mounted on a vertical drive shaft 12, which is connected to drive means (not shown) for the vessel. A longitudinal axis 18 of the drive shaft 12, about which the drive pinion 8 rotates, is substantially perpendicular to the longitudinal axis 6 of the propeller shaft 4 about which the propeller 2 rotates.

On the top of the azimuth thruster 1 there is positioned a steering engine (not shown), which turns the thruster so that the pulling force vector can be orientated in a decided direction from 0-360 degrees, or a multiple of 360 degrees in both directions. Normally a steering engine consists of hydraulic or electric motors which are connected to a gear rim connected to a vertical stem on the thruster. If the thruster 1 is rotated in still water with the propeller disconnected, this will be easily rotated with a minimum of torque independent of direction. However, if the vessel is moving then due to the propeller forces and the dynamic characteristics of the slipstream there will be a variable torque resistance that varies with rotation rate and vessel speed. If the resistance is larger than the torque steering engine is able to give, the thruster will rotate against the pressure torque from the steering engine. The reason for this is the hydraulic (or flow induced) contribution and the torque archieved on the vertical shaft 12 due to the rotation of the shaft 12.

First to be considered is the torque components which are mechanical. FIG. 1 shows a typical driveline for the azimuth thruster 1. The vertical oriented pinion 10 is connected to a drive means and in this situation the rotation direction 14 of the pinion 10 is clockwise, as seen in the plan view. Further, the engagement point of the pinion 10 will be on the upper part of the crown wheel 8, which gives a rotation direction 16 of the propeller 2 which is anticlockwise (as seen in plan view in FIG. 1). Alternatively, the engagement point of the pinion 10 may be on the lower part of the crown wheel 8. The longitudinal axis of the rotation 18 of the driving pinion is located forward of the crown wheel 8.

As the pinion 10 is rotating with a given rotational speed, and in a direction 14 as shown at FIG. 1, then the thruster 1 will be rotated in the same direction 15 as the pinion 10 direction 14 due to the frictional forces; this "pinion torque" must be absorbed by the steering engine system of the thruster 1.

Due to the rotation of the propeller 2 there is also a torque of moment which as in the rotational axis 18 of the pinion 10, generally known to the skilled person in the art as a gyro torque. Due to the moment of inertia and the angular velocity, the thruster 1 will rotate in the same rotational direction 14 of the pinion 10. Thus, it will be apparent that the direction of the torque for a driveline as here described is equal to what has been discussed above with respect to the pinion torque. The gyro torque is relatively small in relation to the torque which has to be taken up in the steering engine of the thruster 1.

There follows a discussion of the hydro dynamical induced torques which are acting in the horizontal plane and which have an importance for the dimensions and the direction of the thruster 1 features. For a principle understanding of this it is first necessary to look at the forces that will be induced for a pulling thruster 1 given by the combination of the propellers slipstream velocity and the free-stream velocity.

Figure 2:
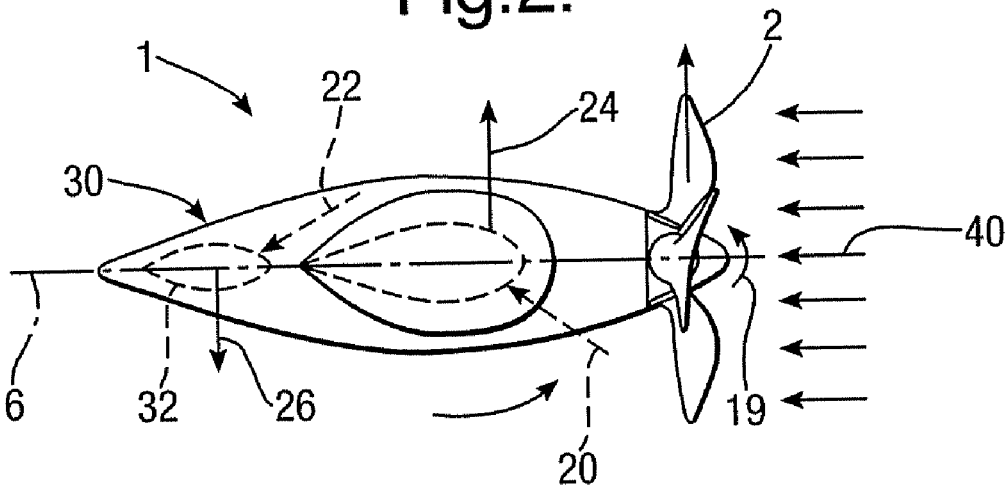
FIG. 2 is a plan view the propulsion and steering unit shown in FIG. 1 and shows forces and velocities experienced by the unit.

In FIG. 2 there is shown the azimuth thruster 1 including an outer housing 30 that is situated below the vessel. The outer housing 30 contains the propeller shaft 4, the crown wheel 8 and the pinion 10. The propeller 2 is disposed externally of one end of the housing 30. FIG. 2 shows the thruster 1 situated with a steering angle of zero degrees with respect to the free stream 40. Due to the rotation of the propeller 2 in direction 19 (this situation clockwise about the axis 6), this will cause a rotation of the slipstream of the propeller 2. Therefore, the instream to the upper gearbox will provide an attack angle in relation to the centerline axis 6. The velocities of speed shown by the dotted arrow 20 will give a lift with a component parallel to the transversal axis of the section; these forces are shown by solid arrow 24.

In one embodiment of the present invention, the thruster 1 comprises a fin 32 that extends downwardly from the lower aft region of the housing 30. The corresponding velocities of speed shown by the dotted arrow 22 will give a lift with a component parallel to the transversal axis of the section, these forces are shown by solid arrow 26 will occur with a fin 32 in the aft end on the underside of the thruster 1, but with another direction of the respective arrows 20, 24, as a resulting slipstream vector under the horizontal propeller center plane will have an other orientation than above the plane. The sideforce component which acts on the propeller depends on the direction of rotation and on the advance number and its magnitude is relatively small at neutral steering angle, as shown on FIG. 2

Figure 3A:
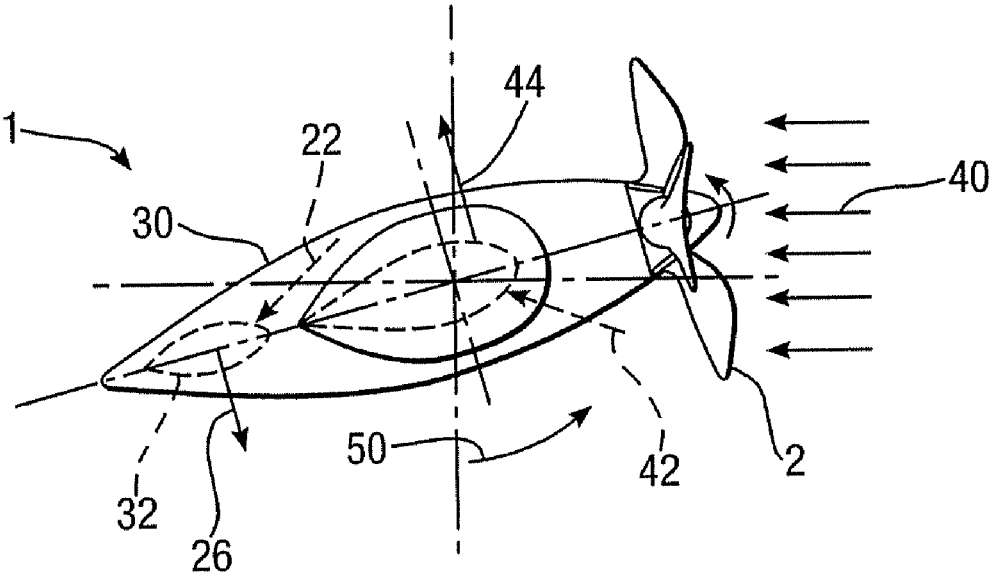
FIG. 3*a* is a plan view the propulsion and steering unit shown in FIG. 1 when rotated to the port side and shows forces and velocities experienced by the unit.
Figure 3B:
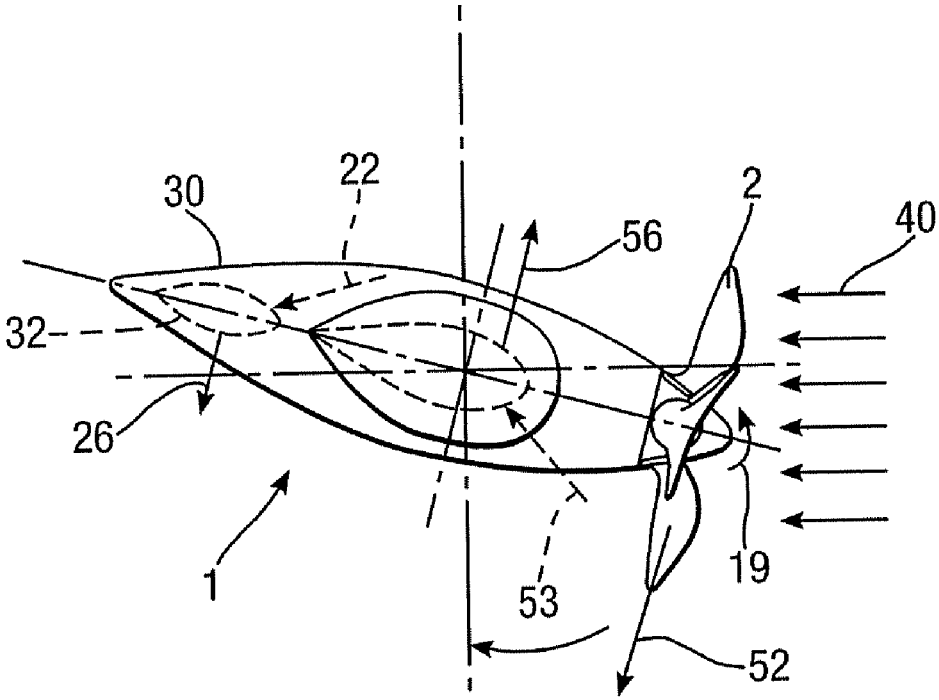
FIG. 3*b* is a plan view the propulsion and steering unit shown in FIG. 1 when rotated to starboard side and shows forces and velocities experienced by the unit.

FIGS. 3*a* and 3*b* show the forces and torque on the thruster 1 when swinging to the port side (FIG. 3*a*) and the starboard side (FIG. 3*b*).

FIGS. 3*a* and 3*b* show a situation where the thruster 1 is moved to starboard and port side in relation to the free stream 40. By swinging to the port side relative to the slipstream direction 40 will provide an attack angle with the upper streaming body indicated by a dotted arrow 42 which on that side will result in the force component indicated by a full arrow 44. The same will occur with the fin 32, but the slipstream flow will change the direction of the transverse velocity components below the propeller due to the rotation of the propeller. The direction of the force component on the fin 32 will change accordingly such that it will be in the opposite direction (transverse opposite) to the streamlined part above the propeller shaft. When turning to starboard (FIG. 3*b*) in relation to the free stream 40, the force picture at the upper streaming body will be substantially equal to the force picture in the other situation, but there will be the force 52 from the propeller which will change both in direction and in size. This change is due to the fact that the effective attacking angle will increase in the clockwise direction. This, in addition to the fact that the attacking point of the force is rather large, will cause the torque to change direction. By swinging to the starboard side relative to the slipstream direction 40, will provide an attack angle with the upper streaming body indicated by a dotted arrow 53 which on that side will result in the force component indicated by a full arrow 56.

Figure 4:
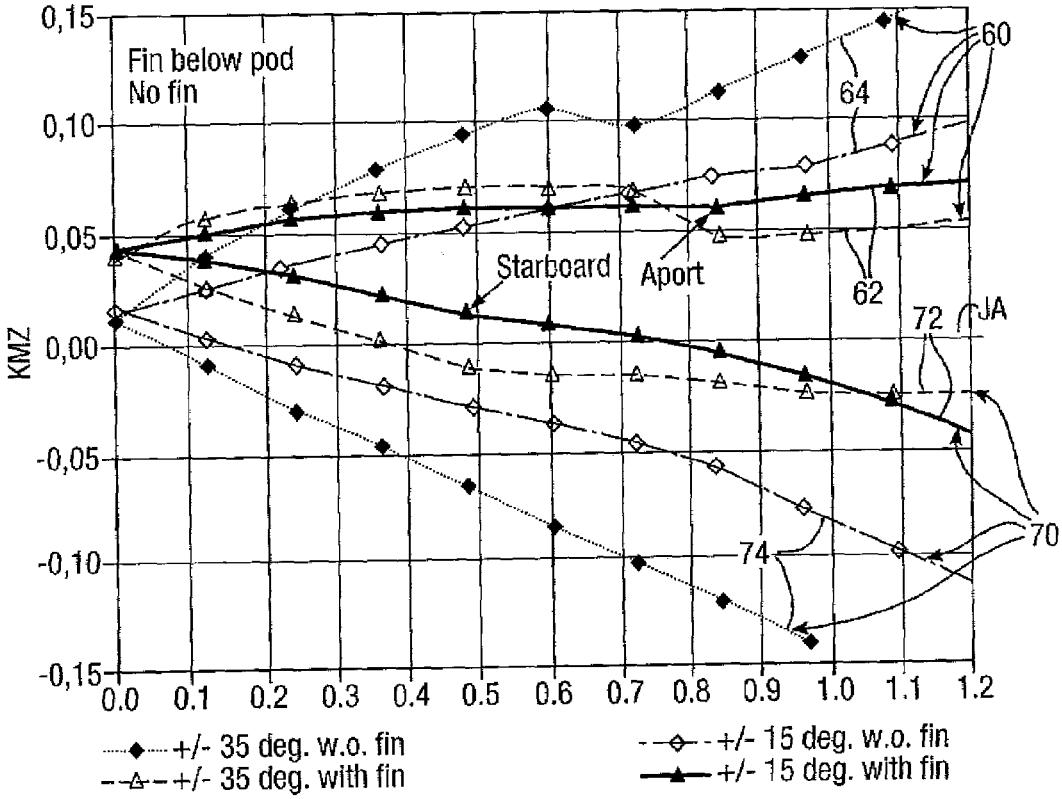
FIG. 4 is a graph of test results, where the hydrodynamic induced steering torque is compared for a steering unit with and without a fin and shows the non-dimensional steering torque (KMZ) is plotted against the advance number ($J_A$), which is also non-dimensional.

In FIG. 4 there is shown the results from model tests with a thruster according to the present invention, where the hydrodynamic steering torque is presented as a function of the advance coefficient number ($J_A$) wherein:

$$J_A = \frac{V_A}{N \cdot D}$$

$V_A$=Advanced velocity of the propeller (meters per second)

N=Propeller rate of revolution (revolutions per second)

D=Propeller diameter (meter)

In practical aspects this can be regarded as proportional with the velocity of the propeller through the water when the revolutions are kept constant for a given propeller diameter. These are measured by turning to the starboard side or the port side with 15 and 35 degrees with or without a fin. Two substantial tendencies can be observed from these measurements: it is seen that there are substantial differences in measured non-dimensional steering engine torque (KMZ, which is without dimensions and corresponds to reference 50 in FIG. 3) dependent of which direction it is steered. The values 60 for the port side turn are substantially higher than the values 70 for the starboard turn both for 15 degrees and for 35 degrees and this is thus consistent with the above deduction. Further it is also noted that there is registered a large reduction in values 62, 72 which is achieved when the thruster is driven with a fin 32 compared to the values 64, 74 achieved without a fin 32.

Following the above description the skilled person will appreciate that the rotational direction of the pinion 10 will be of great importance for the size of the total steering engine torque and therefore also for the dimension forces and torques which has to be the basis for the election of steering engine. In order to achieve this it is necessary to select the rotational direction of the pinion 10 so that it acts against the hydrodynamic torque by turning in the direction, when the hydrodynamic torque is the greatest, and selecting the rotational direction of the pinion 10 so that it acts with the hydrodynamic torque by turning in the direction when the hydrodynamic torque is the smallest.

Figure 5:
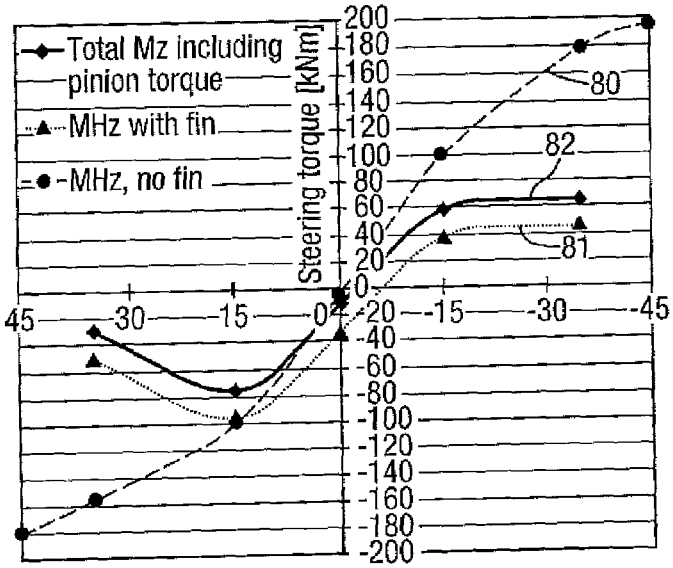
FIG. 5 is a graph where model test results are converted to a full scale application and the hydrodynamic steering torque for a sample full scale case as well as the total engine torque (including pinion torque) is plotted against the azimuth rotation angle.
Figure 6:
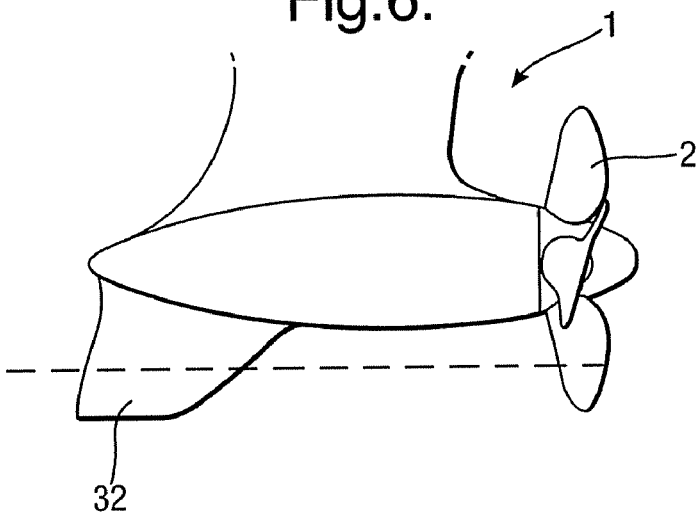
FIG. 6 is a side view of the propulsion and steering unit.
Figure 7:
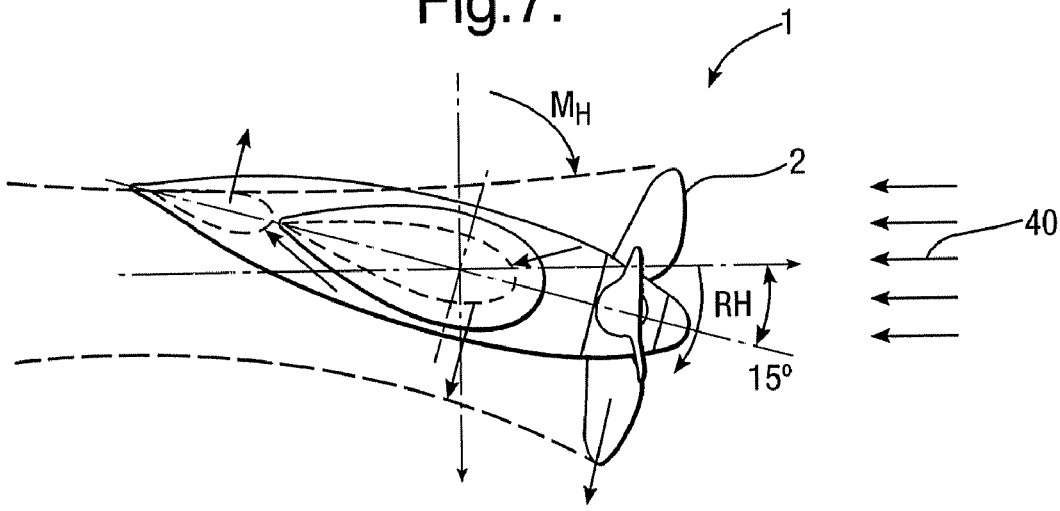
FIG. 7 is a plan view of a right hand rotating propulsion and steering unit and shows the slipstream pattern induced forces acting.
Figure 8:
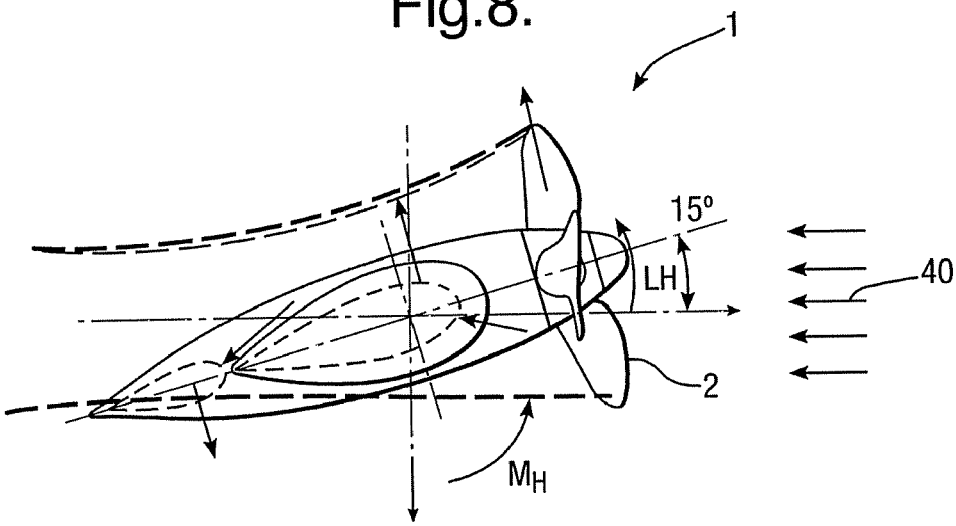
FIG. 8 is a plan view of a left hand rotating propulsion and steering unit and shows the slipstream pattern induced forces acting when the unit is steered in the opposite direction as that shown in FIG. 7.
Figure 9:
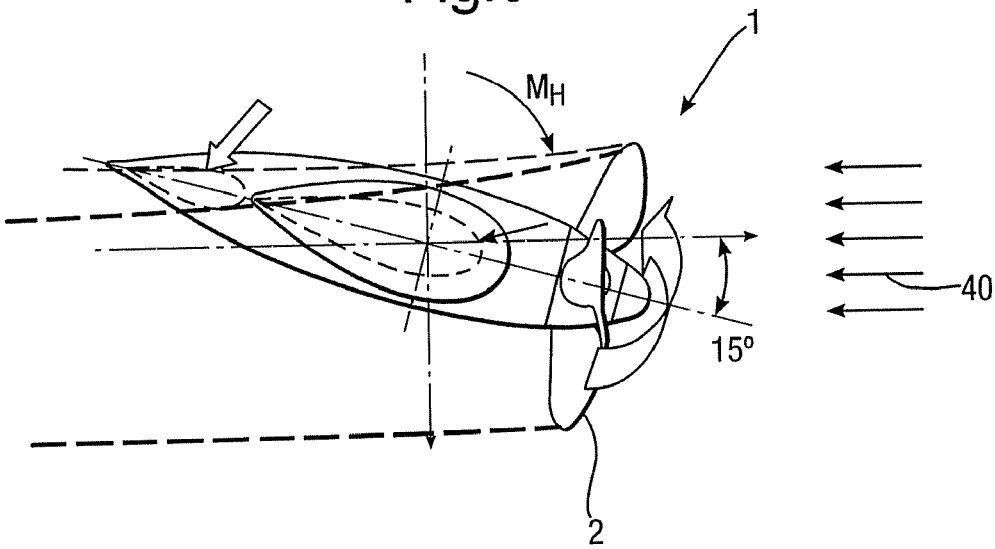
FIG. 9 is a plan view of a left hand rotating propulsion and steering unit and shows the slipstream pattern induced forces acting when the unit is steered in the same direction as that shown in FIG. 7.

This principle is illustrated in FIG. 5, which shows further results from the case where the non-dimensional model tests results of hydrodynamic steering moment with and without the fin are extrapolated to full scale and where the version with the fin is combined with the pinion torque according to the present invention.

With reference to FIG. 5, the dotted line 80 shows the hydrodynamic steering engine torque for the thruster 1 without a fin 32 (MHz, no fin). Comparing this with the dotted line 81 which shows the hydrodynamic steering engine torque for the thruster 1 situation with a fin 32 (MHz with fin). The results clearly show that there is a substantial difference between the torque values 80 and 81, especially for values larger than 15 degrees for turning in both directions. For positive rudder deflections (deflections to the port side) there is a torque of approximately 100 kNm, while for negative deflections (turning to starboard) there is a torque of more than 40 kNm. This is an expression for the asymmetry which is discussed above. Further there is also a significant difference for the steering engine torque for the thruster 1 with and without fin 32, especially for steering angles above 15 degrees. For steering angles +−15 degrees (which is the most used interval for normal steering), there is a reduction of 40-50% in the necessary steering engine torque, in favour of thrusters with a fin.

When the size of the steering engine is selected, it is of course necessary to take into account the largest occurring torques and in the actual full scale case (see FIG. 5) the maximum hydrodynamic contribution is about 100 kNm.

It is in this connection that the rotational direction of the shaft 12 of the pinion 10 becomes important. With reference to FIG. 3, the rotational direction is selected so that the pinion torque acts against the hydrodynamic torque at the point at which the hydrodynamic torque is largest (deflection to the port side), and the rotational direction is selected so that the pinion torque acts with the hydrodynamic torque at the point at which the hydrodynamic torque is smallest (deflection to the starboard side). This is illustrated by the curve 82 in FIG. 5, which then shows that the absolute maximum for the steering engine torque is reduced with approximately 20 kNm, to approximately 80 kNm. Thereby the dimensioning torque 80 kNm which implicates a smaller steering engine with clear advantages with respect to arrangement and costs.

With reference to FIGS. 6 to 9, there is provided further explanation as to why the flow induced steering torque is asymmetric with respect to a starboard azimuth rotation and a port azimuth rotation. The same slipstream pattern and induced forces will act on a left hand rotating propeller (LH, see FIG. 8) and a right hand rotating propeller (RH, see FIG. 7) that moves to the same but opposite azimuth angle.

The left hand rotating propeller (see FIG. 9) when moved to starboard will generate a different slipstream pattern compared to the same azimuth angle moved to port. Thus, the steering moment as a function of the azimuth angle will be asymmetric with regard to the azimuth movements to starboard and to port. With the left hand propeller moved to starboard, the fin fades out of the slipstream at lower azimuth angles, compared to the same movements to port. Therefore, the opposing force on the fin 32 due to the freestream flow will contribute to the reduced steering torque at lower azimuth angles.

The invention claimed is:

1. A propulsion and steering unit for a waterborne vessel, the propulsion and steering unit comprising a pod having a front end in the forward direction of travel of the vessel and a rear end, a fin element, a propeller and propeller shaft, the propeller being disposed externally at the front of the pod and being rotatable about a longitudinal axis of a propeller shaft, the propeller shaft being drivingly connected to drive means, the drive means comprising a driving pinion and a driven wheel, the unit further comprising steering means for rotating the unit about an axis substantially perpendicular to the longitudinal axis of the propeller, wherein the fin element extends downwards from the pod on the opposite side of the axis of rotation of the drive shaft than the propeller, and further wherein the location of the driving pinion on the driven wheel is such that, in use, the rotational direction of the drive pinion produces a torque that acts against a maximum hydrodynamic torque generated by a rotation of the propeller and a rotation of the unit by the steering means, thereby reducing the steering means torque.

2. A propulsion and steering unit as claimed in claim 1, wherein the location of the axis of rotation of the driving pinion is forward of the driven wheel.

3. A propulsion and steering unit as claimed in claim 1, wherein the longitudinal axis of rotation of the driven wheel is located below the driving pinion.

4. A propulsion and steering unit as claimed in any one of the preceding claims, wherein the rotational axis of the drive pinion is substantially perpendicular to the rotational axis of the propeller.

* * * * *